United States Patent [19]

Czosnyka

[11] Patent Number: 4,842,189

[45] Date of Patent: Jun. 27, 1989

[54] SELF-SUPPORTING STORAGE CONTAINER

[76] Inventor: Mitch Czosnyka, 118 S. Hillside, Northlake, Ill. 60164

[21] Appl. No.: 166,435

[22] Filed: Mar. 10, 1988

[51] Int. Cl.[4] ..... B65D 5/20

[52] U.S. Cl. ..... 229/143; 229/52 B; 229/148

[58] Field of Search ..... 229/16 R, 142, 143, 229/148, 154, 6 R, 52 B

[56] References Cited

U.S. PATENT DOCUMENTS

| | | | |
|---|---|---|---|
| 2,711,281 | 6/1955 | Argodale | 229/52 B |
| 2,764,336 | 9/1956 | White | 229/148 |
| 2,788,933 | 4/1951 | Kessler | 229/52 B |
| 2,987,235 | 6/1961 | McCallum | 229/52 B |
| 3,670,949 | 6/1972 | Galanes | 229/52 B |
| 4,003,515 | 1/1977 | Steele | 229/148 |
| 4,236,740 | 12/1980 | Sorenson et al. | 229/143 |
| 4,471,902 | 9/1984 | Skaggs | 229/143 |

FOREIGN PATENT DOCUMENTS

| | | | |
|---|---|---|---|
| 2159213 | 1/1973 | Fed. Rep. of Germany | 229/52 B |
| 358030 | 12/1961 | Switzerland | 229/148 |

*Primary Examiner*—Stephen Marcus
*Assistant Examiner*—Gary E. Elkins
*Attorney, Agent, or Firm*—Railford A. Blackstone, Jr.

[57] ABSTRACT

A carton blank formed from a continuous sheet of material and capable of being easily folded into a self-supporting carton structure. A unique cover locking arrangement is provided whereby both lids forming the cover are independently locked against accidental opening without the aid of external fasteners and further provide superior protection for the contents of the carton against dust and moisture. The absence of external fasteners also make the carton more economical to manufacture and aesthetically pleasing to look at. The carton is also equipped with improved hand holes to facilitate balancing and carrying of the box when loaded.

5 Claims, 3 Drawing Sheets

FIG 2
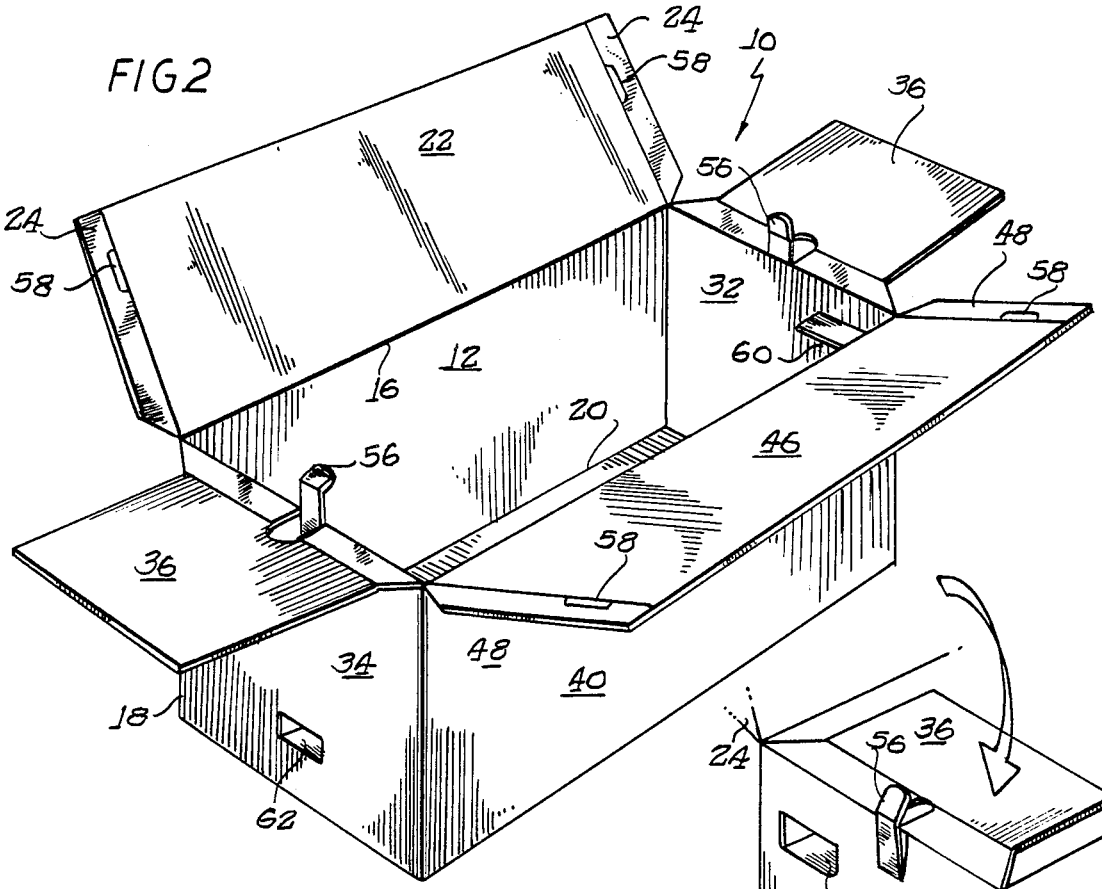
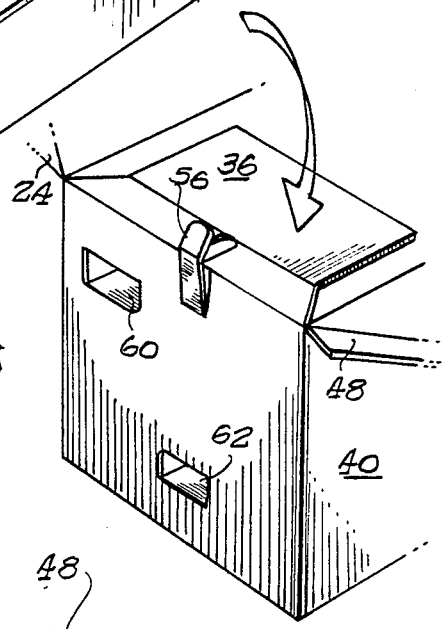
FIG. 3
FIG. 4
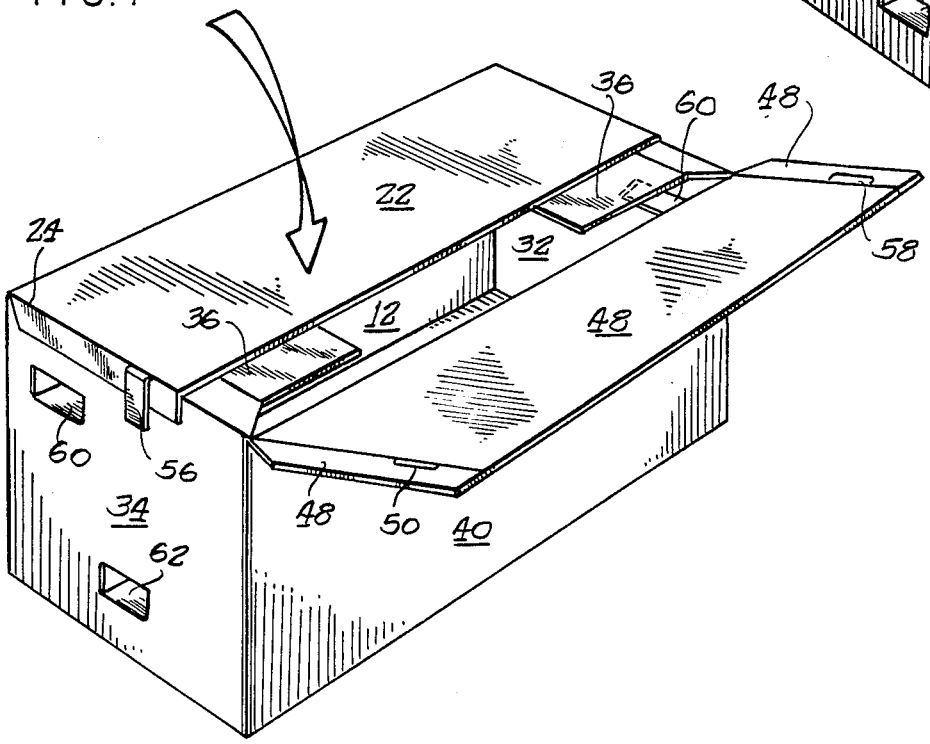

SELF-SUPPORTING STORAGE CONTAINER

BACKGROUND OF THE INVENTION

This invention relates to a storage container for storing files and the like. More particularly, this invention concerns a storage container formed from a continuous sheet of material which is foldable into a unique, self-supporting carton structure.

In general, storage boxes of the type here discussed are manufactured from cardboard blanks which are cut and glued so as to be easily formable into collapsible boxes of various configurations. The collapsible design of the cartons enables them to be economically shipped and stored in substantially flat, disassembled shape. The disassembled carton need not be assembled by the customer until actually needed, and generally may be collapsed, re-stored and re-used at a later time.

Many box designs of this type include lids or covers which can be secured to protect the stored contents of the box from dust or moisture. The covers also allow the cartons to be stacked on top of each other without damaging the contents held within. Some examples are seen in U.S. Pat. Nos. 2,044,301; 2,465,324; 2,731,191; 3,409,204; 4,017,019; 4,339,069 and 4,403,729. One such cover system which is widely known and used includes a pair of lids extending from opposite sides of a carton, designed to swing shut and overlap each other when closed. To secure the cover system in place, one of the lids is provided with eyelets having strings attached thereto. The strings can be manually wrapped around buttons or the like which must be separately fastened to the exterior of the box. Alternatively, some known box designs utilize velcro material in place of the string tie arrangement to secure the lids in place.

One of the drawbacks in securing the lids in this manner, is that the lids may be accidentally opened during positioning or stacking of the storage cartons if the lids or fasteners come into contact with other cartons, racks, or shelving. Since only one of the lids is fastened by the known cover systems, accidental opening of the secured lid will cause the entire contents of the box to be exposed.

Also, even when properly secured the lid designs of the type here discussed often provide less than adequate dust and moisture protection for the contents of the box.

Another drawback associated with known carton designs of this type is the difficulty in manually carrying a loaded carton. Most of the difficulty is attributable to the inferior handle means normally provided.

Handles for other purposes, such as those provided to pull an individual box out from an array of box storage are also commonly added to the carton designs known in the art. Usually, these handles are constructed from other materials, such as plastic, and must therefore be added to the box in a separate assembly step, which, combined with the strings, eyelets, buttons and/or velcro also needed, tend to make the cost of manufacturing such a carton blank expensive.

SUMMARY OF THE INVENTION

It is a general object of this invention to provide a self-supporting storage container formed from a continuous blank of material.

It is a related object to provide a storage container which provides a superior lid system which eliminates exposure of the contents of the container to dust and moisture without requiring the use of independent fasteners.

It is another object of the present invention to provide a storage container which is easy to balance and manually transport when loaded.

A still further object is to provide a collapsible carton which is aesthetically pleasing, easy to use, and relatively inexpensive to manufacture.

Briefly stated, the invention comprises a carton blank for forming a self-supporting storage structure having a series of integrally connected foldable wall panels, and means for connecting the blank together to form a completed container. At least two cover wall panels are included in the blank which fold over one another to close the carton and protect the contents stored within. Securing the cover wall panels in a closed position is accomplished by providing apertures formed in each of the cover wall panels adapted to accept locking tabs formed integral with and extending outward from side wall panels which also form part of the carton blank. The locking tabs secure both cover wall panels independently and thereby provide double protection against accidental opening of the carton.

Side closure flaps extending from said cover wall panels fold over the side wall panels when the carton is closed thereby providing superior protection for the contents stored within the carton against dust and moisture.

The carton also includes hand-hole apertures formed in the side wall panels which are offset with respect to one another to facilitate balancing and manually transporting the carton when loaded with files or the like.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings in which like reference numerals identify like elements, and in which:

FIG. 2 is a perspective view of the storage container with the cover wall panels in an open position;

FIG. 3 is a partial perspective view of the container showing an inner-lid flap portion of a side wall panel in the closed position;

FIG. 4 is a perspective view showing one of the cover wall panels closed;

DETAILED DESCRIPTION OF THE INVENTION

Figure 1:
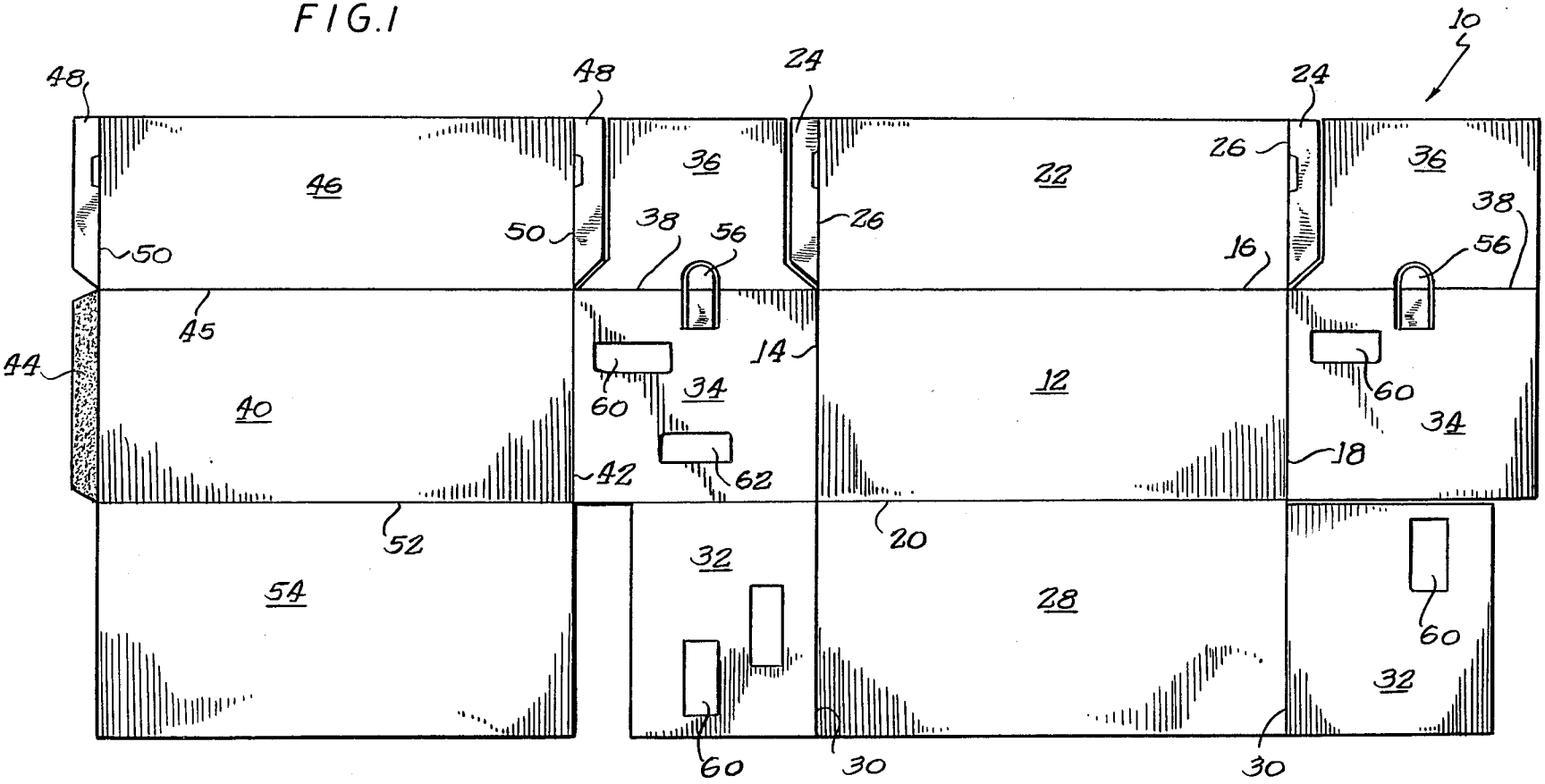
FIG. 1 is plan view of the blank for the storage container.

Referring now to the drawings, there is shown in FIG. 1 a carton blank 10 comprising a series of wall panels including a back panel 12 which is bounded by score lines 4, 16, 18 and 20. Above the back panel 12 in FIG. 1, is a rear cover wall panel 22 hingedly attached along score line 16 to the back panel 12. The rear cover wall panel 22, which functions in conjunction with another cover wall panel to extend over the contents stored in the carton as will be discussed in greater detail below, further comprises side closure flaps 24 which extend perpendicular to score line 16 and are hinged along fold lines 26. Below the back panel 12, as viewed in FIG. 1, is located an outer bottom panel 28 hingedly attached to the back panel 12 along score line 20. The outer bottom panel 28 has fold lines 30 projecting orthogonally with respect to score line 20 from which inner side wall panels 32 extend. Once the carton blank 10 has been squared-up into a completed self-supporting carton structure as is more fully discussed below., the inner side wall panels 32 will stand vertically and, among other things, function to provide structural integrity to the carton.

Outer side wall panels 34 are also included in the carton blank 10 and are integrally attached to back panel 12 along score lines 14 and 18. Both outer side wall panels include inner lid flap portions 36 which extend upwardly from fold lines 38 and are severed to avoid side closure flaps 24 projecting from the rear cover panel 22.

Further in accordance with the invention, a front panel 40 is hingedly engaged with one of the outer side wall panels across a score line 42 as illustrated in FIG. 1. The front panel 40 preferably has dimensions substantially similar to those of back panel 12 and further includes a glue-strip 44 diametrically opposed from score line 42. The glue strip 42 provides means for connecting the front panel 40 to the outer side panel 34 which is not connected to the front panel 40 along score line 42.

Additionally, a front cover wall panel 46 is disposed above a score line 45 as viewed in FIG. 1 and includes side closure flaps 48, similar in shape and size to rear cover panel side closure flaps 24, extending laterally outward along fold lines 50. To complete the blank 10, an inner bottom panel 54 is disposed below front panel 40 along score line 52. As will be seen below, the inner bottom panel 54 will function to reinforce the outer bottom panel 28 when the carton blank 10 is assembled.

Referring now to FIG. 2, it can be appreciated that once the glue strip 44 has adhered to outer side wall panel 34, as discussed above, the carton blank 10 may be squared-up and folded into a self-supporting carton structure having two-ply sidewalls comprising outer side wall panels 34 standing adjacent to inner side wall panels 32 and a double-ply bottom comprising inner bottom panel 54 lying on top of outer bottom panel 28.

Figure 5:
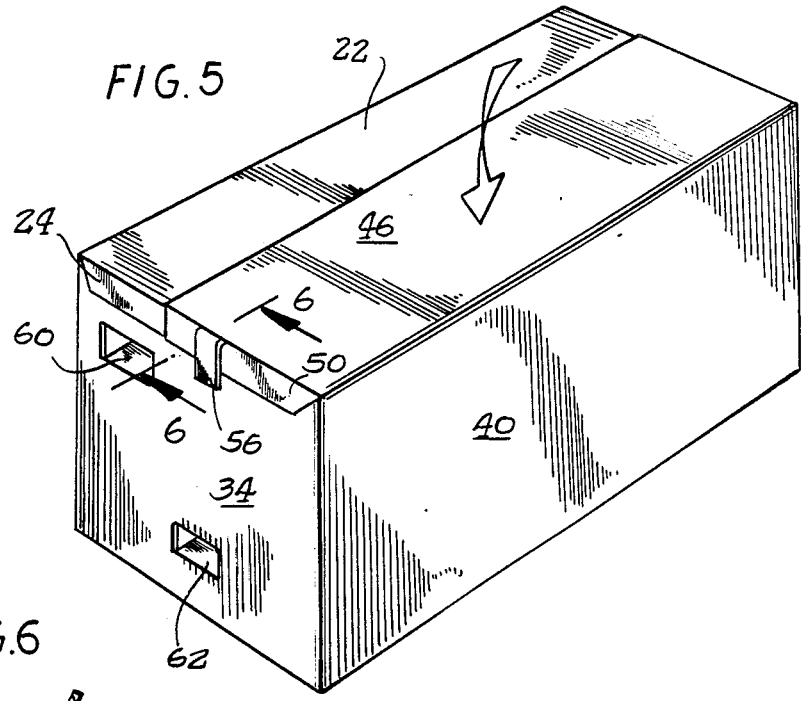
FIG. 5 is a perspective view showing both of the cover wall panels closed.

In an effort to clearly illustrate a unique "double cover lock" aspect of the invention, FIGS. 2–4 define a sequence beginning with the front and rear cover wall panels 22 and 46 and the inner lid flaps 36 in a fully open position (FIG. 2) and ending in a fully secured position (FIG. 5). To provide means for locking the cover wall panels in a closed position, locking tabs 56 are cut out of outer side wall panels 34 such that they extend across fold line 38 and remain attached to the panels 34. The tabs 56 are free to project away from the side walls as shown in FIGS. 2 and 3. Once the inner lid flaps 36 have been folded over (FIG. 3), the cover wall panels 22 and 46 can be closed to cover the carton in overlapping relationship with one another. Closure flaps 24 and 48 also fold over each other and partially over side wall panels 34 thereby providing superior protecting of the contents stored in the carton from dust and moisture.

Figure 6:
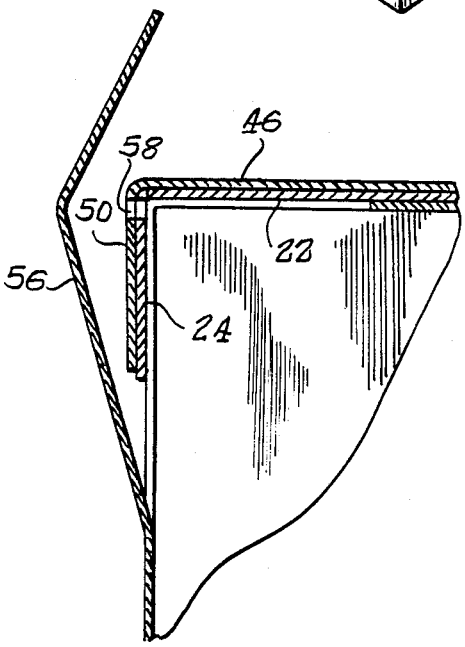
FIG. 6 is a sectional view taken along line 6—6 shown in FIG. 5 with a locking tab portion of a side wall panel positioned prior to being inserted into a cover wall panel aperture.
Figure 7:
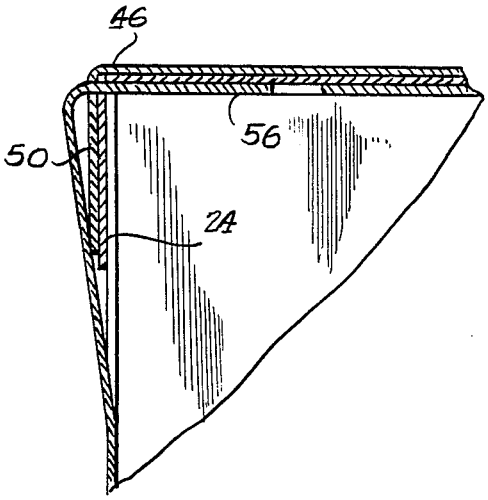
FIG. 7 is a sectional view similar to FIG. 6, but with a locking tab pushed through a cover wall aperture.

To lock the cover wall panels, the tabs 56 are inserted into apertures 58 formed in closure flaps 24 and 48 so as to align and form a through passage for the tabs 56 when the cover wall panels 22 and 46 are completely closed as illustrated in FIGS. 6 and 7. Preferably, both the rear cover wall 22 and the front cover wall 46 are in a fully closed position before locking tabs 56 are inserted. However, as can be readily seen by viewing FIG. 4, the locking tabs 56 can be inserted through the apertures 58 with, for example, only the rear cover wall panel 22 closed. This demonstrates a unique aspect of the invention in that it simulates the condition of the carton if one of the cover wall panels was accidentally torn away during shipment or maneuvering of the carton. That is, the carton remains substantially covered by inner lid flaps 36 and a single cover wall panel despite the damage sustained. Consequently, the contents of the box remained substantially protected from dust and moisture.

In accordance with another aspect of the invention, hand-holes 60 are formed in outer side walls 34 and in inner side wall panels 32 so as to line up when the carton blank 10 is assembled as in FIGS. 2–5. As best seen in FIGS. 2 and 4, the hand-holes 60 are offset with respect to one another to provide means for enabling the carton to be easily balanced and carried by hand.

For the purpose of allowing the carton to be pulled out or pushed back into an array of carton storage as would be found, for example, in a file storage room, a handle 62 is also provided in at least one of the outer side walls 34 and inner side walls 32. Again, the holes cut in the carton blank 10 for the handle 62 are designed so as to be in alignment with one another once the carton is assembled.

In assembled form, the carton 10 has no handles projecting nor strings hanging from its exterior and thus presents an aesthetically pleasing appearance. The lack of the need for separate strings, handles etc. also significantly reduces the cost of manufacturing and therefore makes the carton more economical.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A carton blank for forming a self-supporting storage structure comprising: a series of integrally connected foldable wall panels including side wall panels and two cover wall panels, and at least one tab means formed from a portion of said side wall panels for extending through apertures formed in said cover wall panels, wherein each of said tab means will independently secure both of said cover wall panels in a closed position by simultaneously extending through an aperture in each cover wall panel, thereby guarding against exposure of carton contents in the event of accidental opening of one of said cover wall panels.

2. A carton blank as recited in claim 2, wherein said side wall panels further include hand-hole apertures arranged such that said hand-hole apertures are located on opposite sides of central longitudinal vertical plane extending across the length of the assembled carton so as to provide means to easily balance the assembled carton during manual transport thereof.

3. The carton blank recited in claim 1, wherein said carton blank is formed from a continuous sheet of material and further comprises:

a back panel having score lines defining a top edge, a bottom edge, and side edges;

an outer bottom panel hingedly extending from said bottom edge of said back panel and having side edges from which inner side wall panels extend;

a rear cover panel hingedly extending from said top edge of said back panel and having side edges from which closure flaps including lid-lock apertures extend;

an outer side wall panel hingedly extending from each of said back panel side edges, each of said outer side wall panels having an outside edge and an upper edge from which an inner lid flap portion extends;

a front panel hingedly extending from an outside edge of one of said outer side wall panels and having upper and lower edges;

an inner bottom panel hingedly extending from said lower edge of said front panel;

a front cover panel hingedly extending from said upper edge of said front panel and having side edges from which closure flaps including lid-lock apertures extend, and;

means for connecting said front panel to the outside edge of an outer side wall panel from which the front panel does not extend.

4. The carton blank of claim 3, wherein said inner an outer side wall panels further include hand holes for manually carrying said carton structure, said hand holes being out of alignment with respect to a central axis extending along the length of said carton when assembled.

5. The carton blank of claim 3, wherein said inner and outer side wall panels further include an aligned aperture when in carton form for allowing said carton to be easily removed when located in an array of stored cartons.

* * * * *

UNITED STATES PATENT AND TRADEMARK OFFICE

CERTIFICATE OF CORRECTION

PATENT NO. : 4,842,189

DATED : June 27, 1989

INVENTOR(S) : Mitch Czosnyka

It is certified that error appears in the above-identified patent and that said Letters Patent is hereby corrected as shown below:

Column 2 line 66 "lines 4,16,18 and 20"

--lines 14, 16, 18 and 20--

Column 3 line 20 "wall panels include"

--wall panels 34 include--

Column 3 line 26 "wall panels across"

-- wall panels 34 across--

Column 4 line 67 "in claim 2,"

-- in claim 1,--

Column 5 line 2 "sides of central"

-- sides of a central--

Signed and Sealed this

Fifteenth Day of May, 1990

*Attest:*

HARRY F. MANBECK, JR.

*Attesting Officer*

*Commissioner of Patents and Trademarks*